US006561923B1

(12) United States Patent
Ohama et al.

(10) Patent No.: US 6,561,923 B1
(45) Date of Patent: May 13, 2003

(54) COLORED GOLF BALL

(75) Inventors: Keiji Ohama, Hyogo-ken (JP); Hidenori Hiraoka, Hyogo-ken (JP)

(73) Assignee: Sumitomo Rubber Industries, Ltd., Hyogo-ken (JP)

( * ) Notice: Subject to any disclaimer, the term of this patent is extended or adjusted under 35 U.S.C. 154(b) by 0 days.

(21) Appl. No.: 09/347,398

(22) Filed: Jul. 6, 1999

(30) Foreign Application Priority Data

Jul. 7, 1998 (JP) ..... 10-191433

(51) Int. Cl.[7] ..... A63B 37/12
(52) U.S. Cl. ..... 473/353
(58) Field of Search ..... 40/327; 473/374, 473/353

(56) References Cited

U.S. PATENT DOCUMENTS 4,798,386 A * 1/1989 Berard ..... 40/327
4,865,326 A * 9/1989 Isaac et al. ..... 473/353
5,018,742 A * 5/1991 Isaac et al. ..... 473/353
5,029,870 A * 7/1991 Concepcion et al. ..... 473/353
5,502,100 A * 3/1996 Maruoka et al. ..... 473/353
5,795,247 A * 8/1998 Yokota et al. ..... 473/374
6,022,279 A * 2/2000 Yamagishi et al. ..... 473/353

* cited by examiner

*Primary Examiner*—Mark S. Graham
*Assistant Examiner*—Raeann Gorden
(74) *Attorney, Agent, or Firm*—Birch, Stewart, Kolasch & Birch, LLP

(57) ABSTRACT

The present invention provides a colored golf ball having soft and good shot feel at the time of hitting, and having excellent discriminability when used in bad weather or the winter season because of its vivid and deep color tone. The present invention relates to a colored golf ball comprising a core having at least one layer and a cover having at least one layer formed on the core, wherein the outermost layer of the cover contains 3.0 to 7.0 parts by weight of fluorescent pigment and 0.05 to 0.5 parts by weight of titanium dioxide, the cover being coated with one or more layers of clear coating, and the surface of the golf ball having an L*-value of 50 to 80, measured using a color difference meter.

4 Claims, 1 Drawing Sheet

FIGURE
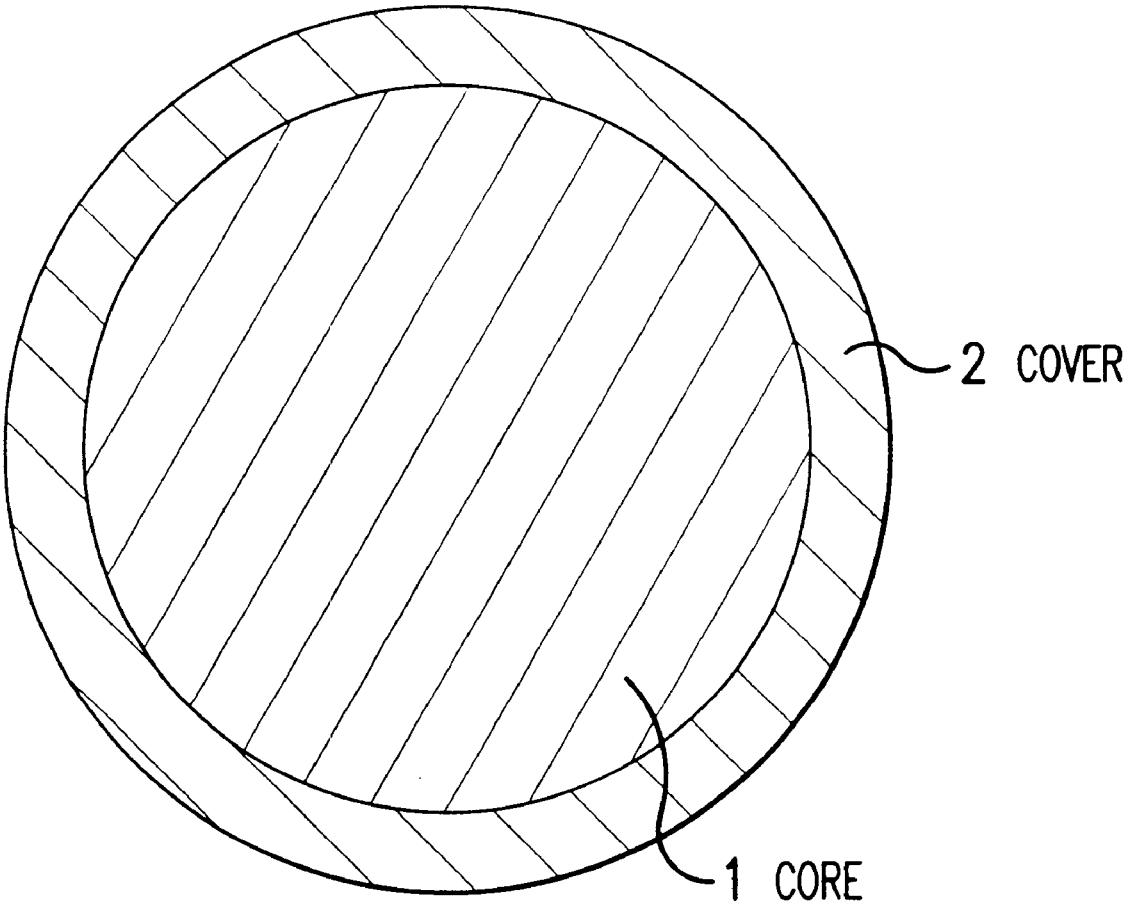

COLORED GOLF BALL

FIELD OF THE INVENTION

The present invention relates to a colored golf ball. More particularly, it relates to a color golf ball having soft and good shot feel at the time of hitting and excellent discriminability because of deep and vivid color tone, when used in bad weather or the winter season.

BACKGROUND OF THE INVENTION

Most of golf balls that are commercially sold have a white appearance. In order to make the golf ball whiter, the cover thereof contains a white pigment such as titanium dioxide or a fluorescent brightener. If the white pigment does not impart sufficient whiteness to the golf balls, the whitened cover is further coated with white paint. Golf balls having a colored appearance other than white appearance, which are called colored golf balls, are also being commercially sold. The colored golf ball has been used because of curiousness or for differentiation from golf balls used by other golfers, but they have not been considered in connection other functions, such as use in bad weather or in the winter season.

The color golf balls, when compared with the golf balls having white appearance, have excellent discriminating value when used in cloudiness, fog or rain conditions, which is often is the case in the mountains where the weather is changeable, or when used on snow or the dormant grass of the winter season. In these situations the colored golf ball seems to have better attributes than the golf balls having a white appearance. On the other hand, since the conventional colored golf balls are produced without taking account of the above points, they exhibit poor shot feel when hit at a low temperature because the impact force at the time of hitting is very large when compared to hitting under usual condition.

The colored golf ball can be obtained by not coating white enamel paint but by coating with colored paint on the surface of the golf ball. Therefore colored golf balls have the problem of appearance such as color shading, which does not occur in the golf balls having a white appearance. Also, when the surface of the colored golf ball is damaged at the time of hitting, its paint layer can peel off, rendering the appearance of the golf ball poor because the difference in the color between the colored paint and the cover layer becomes quite noticeable by the exposure of the underlayer (cover layer).

The color golf balls obtained by introducing an inorganic or organic pigment into the cover composition to color the cover, without coating the cover with colored paint have been proposed. The resulting colored golf balls do not have the problem of the appearance, such as color shading or peeling off. However, excellent discriminability as a new function of the colored golf ball is not sufficient, because the vividness of the color of the cover is not sufficient.

In any case, since conventional colored golf balls have been employed because of curiousness, the need to improve the discriminability of the golf ball for use in bad weather or in the winter season and to solve the problem of the appearance thereof has been neglected.

OBJECTS OF THE INVENTION

A main object of the present invention is to provide a colored golf ball having soft and good shot feel at the time of hitting and excellent discriminability because of vivid and deep colored tone, when using in bad weather or winter season conditions.

According to the present invention, the object described above has been accomplished by employing a cover composition containing a specified amount of fluorescent pigment and titanium dioxide, and by adjusting the L*-value of the surface of the golf ball, measured using a color difference meter, to a specified range. Thus, a colored golf ball is provided having a soft and good shot feel at the time of hitting and excellent discriminability, when used in bad weather or winter season conditions.

SUMMARY OF THE INVENTION

The present invention provides a color golf ball comprising at least one layer of a core and at least one layer of a cover formed on the core, wherein the outermost layer of the cover contains 3.0 to 7.0 parts by weight of fluorescent pigment and 0.05 to 0.5 parts by weight of titanium dioxide. The cover is coated with one or more layers of a clear coating, and the surface of the golf ball has an L*-value of 50 to 80, measured using a color difference meter.

In the colored golf ball of the present invention, it is preferable that (a) the surface of the golf ball has an a*-value of 40 to 70 and a b*-value of 70 to 90, measured using a color difference meter, when the fluorescent pigment is an orangish fluorescent pigment, and (b) the surface of the golf ball has an a*-value of 30 to 60 and a b*-value of 10 to 30, measured using a color difference meter, when the fluorescent pigment is a pinkish fluorescent pigment.

In the present invention, the color difference measurement is conducted by a color-difference-colorimeter, which employs a method of directly reading the tristimulus value and an L*a*b* color specification system, thereby obtaining the L*-value, the a*-value and the b*-value. The L*-value represents lightness, and the a*-value and b*-value represent chromaticity, which is shown as hue and chroma. The surface of the colored golf ball of the present invention has an L*-value of 50 to 80, preferably 60 to 75, measured using a color difference meter. When the L*-value is smaller than 50, the color tone is dark. On the other hand, when the L*-value is larger than 80, the colored tone is pale. Therefore, in both cases, the colored golf ball does not have sufficient discriminability when used in bad weather, or in snow and the dormant grass in the winter season.

The surface of the colored golf ball of present invention has an a*-value of 40 to 70, preferably 45 to 60, and a b*-value of 70 to 90, preferably 75 to 85, measured using a color difference meter, when the golf ball contains an orangish fluorescent pigment, that is, the golf ball has an orangish hue. When the a*-value is out of the range of 40 to 70, and the b*-value is out of the range of 70 to 90, the colored golf ball containing the orangish fluorescent pigment cannot obtain the desired hue, and can not sufficiently obtain a discriminability when used in bad weather, or in snow and dormant grass in winter season. The surface of the colored golf ball of present invention has an a*-value of 30 to 60, preferably 35 to 55, and a b*-value of 10 to 30, preferably 15 to 25, measured using a color difference meter, when the golf ball contains a pinkish fluorescent pigment, that is, the golf ball has a pinkish hue. When the a*-value is out of the range of 30 to 60, and the b*-value is out of the range of 10 to 30, the colored golf ball containing the pinkish fluorescent pigment cannot obtain the desired hue, and can not sufficiently obtain a discriminability when used in bad weather, or in snow and dormant grass in winter season conditions.

In the colored golf ball of the present invention, it is preferable that the golf ball has a deformation amount of 2.90 to 3.60 mm, preferably 2.90 to 3.45 mm, more preferably 3.00 to 3.30 mm, when applying from an initial load of 10 kgf to a final load of 130 kgf on the golf ball, and has a impact force of 950 to 1,200 kgf, preferably 1,000 to 1,150 kgf, when hit at a head speed of 40 m/second by a driver. When the deformation amount is smaller than 2.90 mm, the golf ball is too hard, and the shot feel is poor. On the other hand, when the deformation amount is larger than 3.60 mm, the golf ball is too soft. Therefore the rebound characteristics are degraded, and the shot feel is heavy and poor. When the impact force is smaller than 950 kgf, the shot feel is too light and poor. On the other hand, when the impact force is larger than 1,200 kgf, the impact at the time of hitting is too large, and the shot feel is poor. When playing golf, particularly in the winter season, the shot feel at the time of hitting the golf ball is too hard, as compared to the other seasons, because of the temperature. The colored golf ball of the present invention has a soft and good shot feel, because of softening the ball and reducing an impact force at the time of hitting, in addition to excellent discriminability of the golf ball. Therefore it is easy to play in winter season by using the colored ball of the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

The FIGURE represents a golf ball having a core and a cover provided on the core.

DETAILED DESCRIPTION OF THE INVENTION

The golf ball of the present invention will be explained hereinafter. The golf ball of the present invention comprises at least one layer of a core 1 and at least one layer of a cover 2 formed on the core. The golf ball of the present invention may be either a solid golf ball such as two-piece solid golf ball or a thread wound golf ball. The core used in the present invention may have single layer structure or multi-layer structure that has two or more layers. The core for solid golf balls (solid core) may be the same one that has been conventionally sued, and may be obtained by mixing a rubber composition using a mixer such as a mixing roll, and then vulcanizing (crosslinkling) or press-molding the mixture in a given mold into a spherical form. The rubber composition comprises a base rubber such as polybutadiene rubber, a metal salt of α,β-unsaturated carboxylic acid, an organic peroxide as a co-crosslinking initiator, zinc oxide, optionally filler and the like.

The core for thread wound golf balls (thread wound core) comprises a center and a thread rubber layer formed by winding thread rubber in a stretched state around the center. The center may be either a liquid center or a solid center. The thread rubber can be the same one that has been conventionally used. The thread rubber can be obtained by vulcanizing a rubber composition prepared by formulating sulfur, a vulcanization aid, a vulcanization accelerator, an antioxidant and the like to natural rubber or a blend of natural rubber and a synthetic polyisoprene. The examples of the solid core and the thread wound core are only for the purpose of illustration, and are not to be construed as limiting.

In the golf ball of the present invention, the core 1 is covered with a cover 2. The cover may have single layer structure or multi-layer structure that has two or more layers. The cover of the golf ball of the present invention is preferably formed from ionomer resin or mixtures thereof. The ionomer resin may be a copolymer of α-olefin and α,β-unsaturated carboxylic acid having 3 to 8 carbon atoms, of which a portion of carboxylic acid groups is neutralized with metal ion. Examples of the α-olefins in the ionomer preferably include ethylene, propylene and the like. Examples of the α,β-unsaturated carboxylic acid in the ionomer preferably include acrylic acid, methacrylic acid and the like. The metal ion which neutralizes a portion of carboxylic acid groups of the copolymer includes an alkali metal ion, such as a sodium ion, a potassium ion, a lithium ion and the like; a divalent metal ion, such as a zinc ion, a calcium ion, a magnesium ion and the like; a trivalent metal ion, such as an aluminum ion and the like; and mixture thereof.

Preferred are sodium ions, zinc ions, lithium ions and the like, in view of rebound characteristics, durability and the like. The ionomer resin is not limited, but examples thereof will be shown by a trade name thereof. Examples of the ionomer resins, which are commercially available from Du Pont Co., include Surlyn 1605, Surlyn 1706, Surlyn 1707, Surlyn AD8541, Surlyn AD8542 and the like. Examples of the ionomer resins, which are commercially available from Mitsui Du Pont Polychemical Co., Ltd. include Hi-milan 1557, Hi-milan 1605, Hi-milan 1652, Hi-milan 1705, Hi-milan 1706, Hi-milan 1707, Hi-milan 1855, Hi-milan 1856 and the like. Examples of the ionomer resins, which are commercially available from Exxon Chemical Co., include Iotek 7010, Iotek 8000 and the like. These ionomer resins may be used alone or in combination. The cover composition used in the present invention may contain the other thermoplastic resin, such as polyurethane, polyamide, polyester and the like, in addition to the ionomer resin, depending on the hardness, flight performance, durability and the like of the golf ball. If used, the amount of the resin is preferably up to 20 parts by weight, based on 100 parts by weight of the ionomer resin.

The golf ball of the present invention comprises at least one layer of a cover, and the outermost layer of the cover contains one or more fluorescent pigments and titanium oxide. The fluorescent pigments used in the present invention include those having the color of blue, red, pink, orange, yellow and the like. Preferred are the fluorescent pigments having the color of pink and orange, in view of discriminability. The fluorescent pigments may be used alone or in combination. The amount of the fluorescent pigment is 3.0 to 7.0 parts by weight, preferably 3.5 to 6.5 parts by weight, more preferably 4.0 to 6.0 parts by weight, based on 100 parts weight of the cover resin. When the amount is smaller than 3.0 parts by weight, the golf ball has not sufficient discriminability when used in bad weather, used in on snow and dormant grass in winter season conditions, and has the same discriminability as the conventional white golf balls. When the amount is larger than 7.0 parts by weight, the color tone is too deep and the color definition is degraded, and discriminability is degraded.

The fluorescent pigment is not limited, but examples thereof will be shown by a trade name thereof. Examples of fluorescent pigments include ZQ-19 (blue), ZQ-13 (red orange), ZQ-11 (pink), ZQ-14 (orange), ZQ-15 (orange), ZQ-17 (yellow) and the like, which are commercially available from DAYGLO Co., or mixture thereof. Preferred are ZQ-11 (pink), ZQ-14 (orange), and mixture thereof.

Titanium dioxide used in the outermost layer of the cover of the present invention may be either rutile type or anatase type. The amount of the titanium dioxide is 0.05 to 0.5 parts by weight, preferably 0.1 to 0.4 parts by weight, more preferably 0.1 to 0.3 parts by weight, based on 100 parts by weight of the cover resin. When the amount is smaller than 0.05 parts by weight, the color tone of the underlayer is visible through the cover because the hiding power of the cover is not sufficiently obtained, and a desired color tone can not be obtained. On the other hand, when the amount is larger than 0.5 parts by weight, the color definition of the fluorescent pigment is degraded, and the surface of the golf ball has a whitish color tone.

The cover composition used in the present invention may optionally contain fillers such as barium sulfate, and the other additives such as a dispersant, an antioxidant, a UV absorber, a photostabilizer and the like, in addition to the above components, as long as the addition of the additive does not deteriorate the desired performance of the golf ball cover.

The cover used in the present invention can be formed by a conventional method for forming golf ball cover well known in the art. The method is not specifically limited. For example, there can be used a method comprising the steps of molding the cover composition into a semi-spherical half-shell in advance, covering a core with the two half-shells, followed by pressure molding at 130 to 170° C. for 1 to 15 minutes, or a method comprising injection molding the cover composition directly on the core to cover it.

The cover has a thickness of 1.0 to 3.0 mm, preferably 1.3 to 2.5 mm. When the thickness is smaller than 1.0 mm, the hardness of the resulting golf ball is too low, and the rebound characteristics are degraded and the flight performance as the basic performance of golf balls is degraded. On the other hand, when the thickness is larger than 3.0 mm, the hardness of the resulting golf ball is too high, and the shot feel at the time of hitting is poor.

At the time of molding the cover, many depressions called "dimples" may be optionally formed on the surface of the golf ball. Furthermore, paint finishing or marking with a stamp may be optionally provided after the cover is molded for commercial purposes.

In the present invention, the paint finishing may be conducted by coating one or more layers of clear coating on the cover layer with a clear paint. The clear paint is a weather-resistant non-yellowing urethane paint, of which the whiteness and weather-resistance can be improved by addition of a fluorescent brightener or a UV absorber.

In the present invention, the marking may be conducted by printing a mark directly on the cover layer, and then coating one or more layers of clear coating on the print, or by coating one or more layers of clear coating on the cover layer, printing a mark on the clear coating, and then coating one or more layers of clear coating on the print.

EXAMPLES

The following Examples and Comparative Examples further illustrate the present invention in detail but are not to be construed to limit the scope of the present invention thereto.

Production of Core

The core rubber compositions having formulation shown in Table 1 were mixed and then vulcanized or press-molded in a mold to obtain spherical cores having a diameter of 39.0 mm. The vulcanization was conducted at 160° C. for 20 minutes.

TABLE 1

| | (parts by weight) | | | |
|---|---|---|---|---|
| Core composition | A | B | C | D |
| Polybutadiene *1 | 100 | 100 | 100 | 100 |
| Zinc oxide | 15 | 15 | 13 | 18 |
| Zinc acrylate | 22 | 18 | 25 | 15 |
| Antioxidant *2 | 0.5 | 0.5 | 0.5 | 0.5 |
| Vulcanization initiator *3 | 2.0 | 2.5 | 1.5 | 2.0 |
| Barium sulfate | 10 | 10 | 10 | 10 |

*1 High-cis polybutadiene rubber (trade name "BR-11") available from JSR Co., Ltd.
*2 Antioxidant (trade name "Noclac NS-7") available from Ouchi Sinko Chemical Co., Ltd.
*3 Vulcanization initiator (trade name "Percumyl D") available from Nippon Yushi Co., Ltd.

Preparation of Cover Composition

The cover compositions having formulations shown in Table 2 (the cover composition for Examples) and Table 3 (the cover composition for Comparative Examples) were blended using a tumbler for 20 minutes, and then mixed using a kneading type twin-screw extruder to obtain a pelletized cover compositions. The extrusion conditions were a screw diameter of 45 mm, a screw speed of 200 rpm, and a screw L/D of 35. The formulation materials were heated at 200 to 260° C. at the die position of the extruder.

TABLE 2

| | (parts by weight) | | | |
|---|---|---|---|---|
| Cover composition | E | F | G | H |
| Hi-milan 1605 *4 | 50 | 50 | 50 | 50 |
| Hi-milan 1706 *5 | 50 | 50 | 50 | 50 |
| ZQ-11 (pink) *6 | 5 | — | 2.5 | 2.5 |
| ZQ-14 (orange) *7 | — | 5 | 2.5 | — |
| ZQ-17 (yellow) *8 | — | — | — | 2.5 |
| Titanium dioxide *9 | 0.3 | 0.3 | 0.3 | 0.3 |

TABLE 3

| | (parts by weight) | | | | |
|---|---|---|---|---|---|
| Cover composition | I | J | K | L | M |
| Hi-milan 1605 *4 | 50 | 50 | 50 | 50 | 50 |
| Hi-milan 1706 *5 | 50 | 50 | 50 | 50 | 50 |
| ZQ-11 (pink) *6 | — | 1 | — | — | 5 |
| ZQ-14 (orange) *7 | — | — | 1 | 9 | — |
| ZQ-17 (yellow) *8 | — | — | — | — | — |
| Titanium dioxide *9 | 3.0 | 0.3 | 0.3 | 0.3 | 1.0 |

*4 Hi-milan 1605 (trade name), ethylene-methacrylic acid copolymer ionomer resin obtained by neutralizing with sodium ion, manufactured by Mitsui Du Pont Polychemical Co., Ltd.
*5 Hi-milan 1706 (trade name), ethylene-methacrylic acid copolymer ionomer resin obtained by neutralizing with zinc ion, manufactured by Mitsui Du Pont Polychemical Co., Ltd.
*6 ZQ-11 (trade name), pinkish fluorescent pigment, manufactured by DAYGLO Co.
*7 ZQ-14 (trade name), orangish fluorescent pigment, manufactured by DAYGLO Co.
*8 ZQ-17 (trade name), yellowish fluorescent pigment, manufactured by DAYGLO Co.
*9 A-220 (trade name), available from Ishihara Sangyo Co., Ltd.

Examples 1 to 4 and Comparative Examples 1 to 5

A cover layer was formed by directly injection molding the cover composition having formulation shown in Table 2

(Examples) and Table 3 (Comparative Examples) on the core obtained above. Then, clear paint was applied on the surface to produce a golf ball having a diameter of 42.7 cm. For the resulting golf balls, the color difference of the surface thereof, weight, deformation amount and impact force were measured, and the discriminability (on the lawn, on the dead lawn, and in the fog) and shot feel were evaluated. The results are shown in Table 4 (Examples) and Table 5 (Comparative Examples). The test methods are as follows.

Test Method (1) Color Difference Measurement

The color difference of the surface of the resulting golf ball was measured by using a color-difference-colorimeter manufactured by Minolta Co., Ltd. which employs a method of directly reading tristimulus value and a L*a*b* color specification system.

(2) Discriminability

The discriminability of the resulting golf ball was evaluated by 10 golfers according to a visual observation of the golf ball at 50 yards point distanced from the golf ball when it is on the lawn, on the dead lawn, and in the fog. The evaluation criteria are as follows.

(Evaluation Criteria)

⊙: Not less than 8 out of 10 golfers felt that the golf ball has good discriminability.

○: From 6 to 7 out of 10 golfers felt that the golf ball has good discriminability.

Δ: From 4 to 5 out of 10 golfers felt that the golf ball has good discriminability.

X: Not more than 3 out of 10 golfers felt that the golf ball has good discriminability.

(3) Impact Force

After a driver (a No.1 wood club) was mounted to a swing robot manufactured by True Temper Co. and the golf ball was hit at a head speed of 40 m/second, the acceleration in the opposite direction of moving the golf club on impact was measured by an acceleration pickup attached to the side sole portion of the golf club head on an opposite side of a striking point with the ball in parallel with a surface of a face. The impact force was determined by changing the acceleration into force as represented by the following formula:

$$F=m\times a$$

wherein F represents a force, m represents an acceleration at the time of hitting, and a represents the weight of club head, which is 210 g. The acceleration pickup used is "Acceler type 4374 (trade name)" manufactured by Brueel & Kjaer Co.

(4) Shot Feel

The shot feel at the time of hitting of the golf ball was evaluated by 10 golfers according to a practical hitting test using a No.1 wood club (W#1, a driver) at 10° C. The evaluation criteria are as follows.

(Evaluation Criteria)

⊙: Not less than 8 out of 10 golfers felt that golf ball has good shot feel.

○: From 6 to 7 out of 10 golfers felt that golf ball has good shot feel.

Δ: From 4 to 5 out of 10 golfers felt that golf ball has good shot feel.

X: Not more than 3 golfers felt that golf ball has good shot feel.

Test Result

TABLE 4

| | Test result | | | |
|---|---|---|---|---|
| Example No. | 1 | 2 | 3 | 4 |
| Core composition | A | B | A | B |
| Cover composition | E | F | G | H |
| Color tone | pink | orange | pink | orange |
| L*-value | 72 | 65 | 67 | 75 |
| a*-value | 45 | 55 | 50 | 45 |
| b*-value | 22 | 76 | 28 | 86 |
| Discriminability | | | | |
| On the lawn | ⊙ | ⊙ | ⊙ | ⊙ |
| On the dead lawn | ⊙ | ⊙ | ⊙ | ○ |
| In the fog | ⊙ | ⊙ | ⊙ | ⊙ |
| Ball weight (g) | 45.2 | 45.2 | 45.2 | 45.2 |
| Deformation amount (mm) | 3.10 | 3.20 | 3.10 | 3.20 |
| Impact force (kgf) | 1130 | 1050 | 1130 | 1050 |
| Shot feel | ⊙ | ⊙ | ⊙ | ⊙ |

TABLE 5

| Comparative Example No. | 1 | 2 | 3 | 4 | 5 |
|---|---|---|---|---|---|
| Core composition | C | D | C | D | C |
| Cover composition | I | J | K | L | M |
| Color tone | white | pink | orange | orange | pink |
| L*-value | 90 | 95 | 92 | 48 | 82 |
| a*-value | −1 | 22 | 31 | 58 | 56 |
| b*-value | −6 | 13 | 49 | 71 | 33 |
| Discriminability | | | | | |
| On the lawn | ⊙ | ⊙ | ⊙ | ○ | ⊙ |
| On the dead lawn | ○ | Δ | ○ | Δ | ○ |
| In a dense fog | X | Δ | Δ | 0 | Δ |
| Ball weight (g) | 45.1 | 45.2 | 45.1 | 45.2 | 45.1 |
| Deformation amount (mm) | 2.70 | 3.65 | 2.70 | 3.65 | 2.70 |
| Impact force (kgf) | 1250 | 940 | 1250 | 940 | 1250 |
| Shot feel | X | Δ | X | Δ | X |

As is apparent from the results in Table 4 and Table 5, the golf balls of the present invention of Examples 1 to 4 shown in Table 4, of which a cover composition containing a specified amount of fluorescent pigment and titanium dioxide, and the L*-value of the surface thereof measured using a color difference meter is controlled to a specified range, have very excellent discriminability on the dead lawn and in the fog, as compared to the conventional white golf ball of Comparative Example 1, although they have the same discriminability on the usual lawn as the golf ball of Comparative Example 1. The golf balls of Examples 1 to 4 having a specified range of a deformation amount when applying from an initial load of 10 kgf to a final load of 130 kgf and a impact force, have better shot feel as compared to the golf balls of Comparative Examples 1 to 5.

On the other hand, the golf ball of Example 1 has poor discriminability on the dead lawn and in the fog because of white appearance, and has poor shot feel because of small deformation amount and large impact force. The golf balls of Comparative Examples 2, 3 and 5 have poor discriminability in the fog, because the L*-value is large and the color tone is pale. The golf ball of Example 4 has poor discriminability on the dead lawn, because the L*-value is small and the color tone is dark. The golf balls of Examples 2 and 4 have heavy shot feel because the deformation amount is large and the golf ball is too soft, and have light shot feel because the impact force is too small. The golf balls of Comparative Examples 3 and 5 have poor shot feel, because the deformation amount is small and the impact force is large.

What is claimed is:

1. A colored golf ball comprising a core having at least one layer and a cover having at least one layer formed on the core, wherein the outermost layer of the cover contains 3.0 to 7.0 parts by weight of at least one fluorescent pigment and 0.05 to 0.5 parts by weight of titanium dioxide, and the cover is coated with at least one layer of clear coating, said fluorescent pigment being an orangish fluorescent pigment, and the surface of the golf ball has a chromaticity value shown by an a*-value of 40 to 70 and a chromaticity value shown by a b*-value of 70 to 90, measured using a color difference meter, wherein the surface of the golf ball has an L*-value of 50 to 80, measured using a color difference meter.

2. The colored golf ball according to claim 1, wherein the golf ball has an impact force of 950 to 1,200 kgf, when hit at a head speed of 40 m/second by a driver.

3. A colored golf ball comprising a core having at least one layer and a cover having at least one layer formed on the core, wherein the outermost layer of the cover contains 3.0 to 7.0 parts by weight of at least one fluorescent pigment and 0.05 to 0.5 parts by weight of titanium dioxide, and the cover is coated with at least one layer of clear coating, said fluorescent pigment being a pinkish fluorescent pigment, and the surface of the golf ball has a chromaticity value shown by an a*-value of 30 to 60 and a b*-value of 10 to 30, measured using a color difference meter, wherein the surface of the golf ball has an L*-value of 50 to 80, measured using a color difference meter.

4. The colored golf ball according to claim 3, wherein the golf ball has an impact force of 950 to 1,200 kgf, when hit at a head speed of 40 m/second by a driver.

* * * * *